US006718905B1

(12) United States Patent
Peerson et al.

(10) Patent No.: US 6,718,905 B1
(45) Date of Patent: Apr. 13, 2004

(54) OUTSIDE ADJUSTMENTS FOR PADDLE CRAFT

(75) Inventors: Robert Peerson, High Point, NC (US); Robert McDonough, Greensboro, NC (US); William Smith, Trinity, NC (US)

(73) Assignee: Confluence Holdings Corp., Trinity, NC (US)

( * ) Notice: Subject to any disclaimer, the term of this patent is extended or adjusted under 35 U.S.C. 154(b) by 0 days.

(21) Appl. No.: 10/213,451

(22) Filed: Aug. 6, 2002

(51) Int. Cl.[7] ..... B63B 35/71
(52) U.S. Cl. ..... 114/347
(58) Field of Search ..... 114/347, 343

(56) References Cited

U.S. PATENT DOCUMENTS

| | | | | | |
|---|---|---|---|---|---|
| 4,480,579 | A | * | 11/1984 | Masters | 114/347 |
| 4,715,311 | A | * | 12/1987 | Masters | 114/347 |
| 5,134,964 | A | | 8/1992 | Masters | 114/347 |
| 5,579,715 | A | | 12/1996 | Harrell | 114/361 |
| 5,950,555 | A | * | 9/1999 | Damask | 114/183 R |
| 6,065,421 | A | * | 5/2000 | Haller et al. | 114/347 |
| 6,112,692 | A | * | 9/2000 | Lekhtman | 114/347 |
| 6,305,311 | B1 | | 10/2001 | Cooke | 114/347 |
| 2002/0175542 | A1 | * | 11/2002 | McDonough et al. | 297/195.11 |

FOREIGN PATENT DOCUMENTS

GB 2 134 454 A * 8/1984

OTHER PUBLICATIONS

MPJA Online information from the internet; copyright 2001.
Duraline Products information from the internet; 2001.
3 digital photos of a crank on a boat gunwale; admitted prior art.
2 digital photos of a plunger on a kayak deck, admitted prior art.

* cited by examiner

*Primary Examiner*—Sherman Basinger
(74) *Attorney, Agent, or Firm*—MacCord Mason PLLC

(57) ABSTRACT

An improved paddle craft provides a boater with exterior controls to adjust items within the craft. The craft has a shell made of a substantially continuous surface to prevent the ingress of water and an adjustable item in the paddle craft affecting a boater's ergonomics, a cockpit and cockpit opening and at least one control opening within a boater's reach when the boater is sitting in the cockpit. A control for the adjustable item is mounted to the control opening, wherein the control has a manipulable handle at the control opening through a water resistant mount.

36 Claims, 7 Drawing Sheets

OUTSIDE ADJUSTMENTS FOR PADDLE CRAFT

BACKGROUND OF THE INVENTION

The present invention relates to a paddle craft with a deck or seat, and is particularly useful in kayaks to permit a kayaker to make modifications to adjustable items within the kayak even while he or she has his or her spray skirt on. While the primary discussion herein refers to kayaks, it should be understood that the improvements can be implemented in other paddle craft such as canoes and sit on top kayaks, including wave skis and still be within the scope of the invention.

In kayaks and other paddle craft, the boater establishes a very intimate relationship with the boat, and together they encounter the water. In particular, in turbulent conditions, this close association essentially results in the boat being an extension of the lower portion of the boater's body, with the upper body sticking up above the boat, out of an opening on the deck of the boat called the cockpit. As one example, whitewater and sea kayaking often involve turbulent water around the kayaker. Even in flat water kayaking, the kayaker may perform Eskimo rolls, intentionally or not. In any of these cases, the top of the kayak is doused with copious amounts of water.

Traditionally, to prevent the water from entering into the kayak in these events, the kayaker wears a spray skirt which is made of water repellant material. The peripheral edge of the cockpit opening typically has an upturned, beaded edge, and the bottom of the skirt has elastic or a draw string so that it can be cinched around the upturned, beaded edge and held in place by constriction against the edge below the bead. The skirt extends up to the body of the kayaker and is cinched against the body to keep water from entering the cockpit. However, the skirt is typically loose enough so that the kayaker can move within the opening of the cockpit.

When the kayaker has such a skirt in place, he or she is typically not desirous of removing the skirt, because proper placement can be time consuming. This is particularly acute in whitewater, or rolling seas/lakes which may require quick reflexes. Thus, when the skirt is in place, the kayaker essentially cannot access the inside of the kayak with his hands. The lack of access to the interior of the kayak prevents the kayaker from being able to make adjustments to seat positions, foot post positions, foot brace positions, or the like. Thus, whatever that position is when the kayaker puts the skirt in place must be maintained as long as the skirt is in place. This can be uncomfortable, at best, or dangerous in the event that an adjustment to one of these features is required to give the kayaker maximum capabilities for dealing with dangerous circumstances. At other times it may be desirable to make adjustments for ergonomic or comfort reasons.

Accordingly, there is a need in the art to provide a modified kayak to promote a kayaker's ability to make adjustments to internal settings in the kayak while the skirt is in place. Such a facility is also useful for circumstances where there is no skirt, whether the boat be a kayak or some other craft.

SUMMARY OF THE INVENTION

The present invention fulfills this need in the art by providing an apparatus for permitting adjustments of items within a kayak including an adjustment means adapted for mounting to a shell of a kayak, and a sealing sheet to cover the adjustment means when the adjustment means is mounted to a shell of a kayak and be sealed to the shell of the kayak, the sealing sheet having sufficient flexibility to permit a kayaker to manipulate the adjustment means through the sheet when the sealing sheet and adjustment means are mounted to a shell of a kayak. The adjustment means may take the form of a ratchet. The shell may be of rotomolded or thermoformed plastic, or composite materials.

The invention also provides an improved kayak providing a kayaker with exterior controls to adjust items within the kayak. The paddle craft includes a shell, the shell being made of a continuous surface to prevent the ingress of water except for a cockpit opening and at least one control opening, which is within a kayaker's reach when the kayaker is sitting in the cockpit. A control mounted to the control opening is connected with an item in the kayak to be controlled. A sealing sheet covers the control and seals the control opening to prevent water from being able to pass into the kayak through the control opening. The sealing sheet has sufficient flexibility to permit a kayaker to manipulate the control through the sheet.

Typically, the controls affect ergonomic adjustments. For example, if the kayak has a movable seat, the control may be a seat position control. If the kayak has a foot brace, the control may be a foot brace position control. If the kayak has adjustable thigh braces, the control may be a thigh brace control. If the kayak has a seat and a foot brace, two control openings and corresponding sealing sheets for the two control openings may be provided, with a first control in one of the control openings as a seat position control and a second control in a second control opening as a foot brace position control. If the kayak has a seat with two adjustments, two control openings and corresponding sealing sheets for the two control openings may be provided, with a first control in one of the control openings being a first seat position control and a second control in a second control opening being a second seat position control. Alternatively, the two or more controls may be mounted to a single opening.

If the kayak has an adjustable backrest, the control may be a backrest adjustment control.

In one embodiment the control is a ratchet, which may be connected with the item to be controlled by a band having a length and denticulations that interact with the ratchet and advance the band as the ratchet is ratcheted. The ratchet may have a toggle to tension a strap within the kayak. Alternatively, a ratchet may have a rotating handle to tension a strap within the kayak.

In another embodiment a buckle winds up a strap, line, rope or webbing to advance the strap or webbing.

In another embodiment, the control is pneumatic, based on air pressure. In another embodiment, a rigid cable like a lawn mower throttle control can be used.

The invention also provides a method of kayaking including sitting in a cockpit of a kayak so that one's upper body extends out of a cockpit opening, installing a spray skirt over the cockpit opening to provide a barrier between the outside of the kayak and the interior of the kayak, floating the kayak in a body of water, and manipulating a control on the outside of the kayak to make adjustments inside the kayak without removing the spray skirt.

Manipulating may include manipulating the control through a sealing sheet. Manipulating may include manipulating the control to change a seat position of the kayaker within the kayak, to change a foot brace position, or to change a backrest adjustment. Manipulating may include actuating a ratchet to advance a band.

The kayak may be a sit-on-top kayak or a sit-inside cockpit kayak.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

Figure 1:
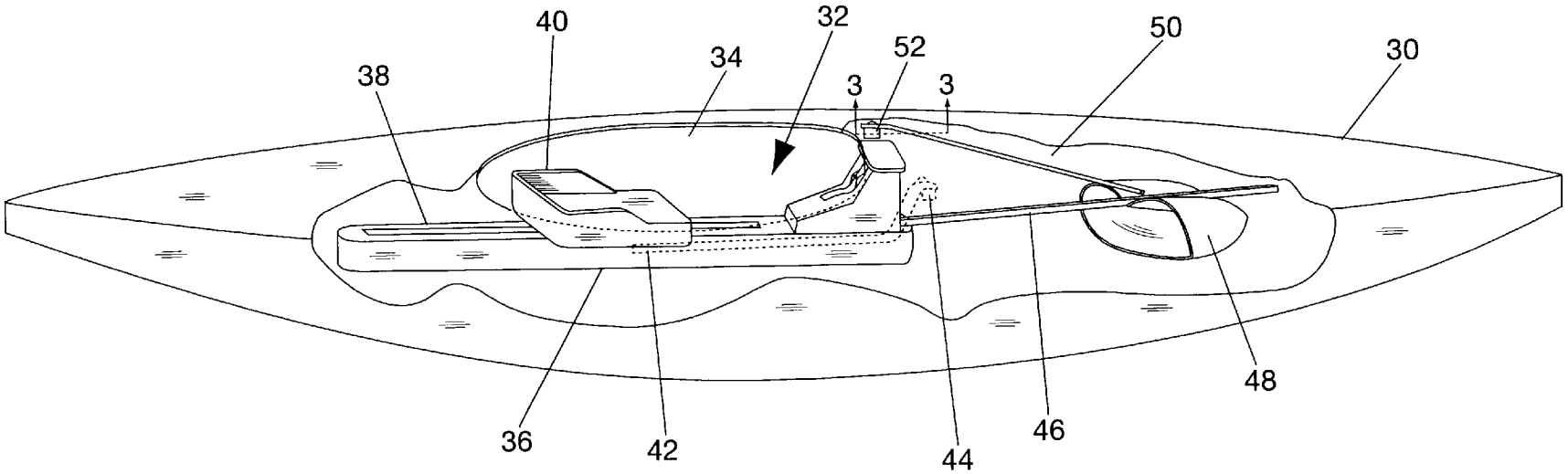
FIG. 1 is a perspective view of a kayak according to one embodiment of the invention, partially broken away.

As seen in FIG. 1, a kayak 30 is provided with a cockpit 32 accessible through a cockpit opening 34. As is conventional, the kayak may have hatch openings with their usual hatch covers. Within the cockpit, a seat support ridge 36 is provided having a groove 38 in which a seat 40 may move fore and aft within the cockpit, permitting the kayaker to select a desired position for comfort and trim. However, such ridges are not included on most boats; most have the seat suspended from an upper position in the hull. Thus, the ridge 36 is not critical. Trim is the fore and aft balance, which affects the tendency of the bow to ride high or low in the water in comparison with the stern. Other adjustable seat constructions may be used. A belt or cable 42 extends from the bottom of the seat through the ridge 36 and out of the front of the ridge to a control opening 44 on the outside surface of the shell of the kayak 30. The shell of the kayak 30 is typically made of thermoformed or rotomolded plastic such as polyethylene, so that the only openings are those intentionally provided, such as the cockpit opening 34 and control openings. However, other means of making the paddle craft, such as with fiberglass layups and resins or the like may also be used.

Another means of adjusting the seat would be to de-activate clamps that secure straps, which would allow the kayaker to move his/her seat using body movements to the desired new position, tighten the attached strap to be in tension and then reactivate the clamps.

Extending forwardly of ridge 36 is a rail 46 on which a foot brace or pod 48 is mounted for fore-and-aft movement. A belt 50 connects the foot brace 48 with a control opening 52 accessible near the cockpit opening 34. Details of the control openings 44 and 52 will be described hereinafter. As can be appreciated, a kayaker can sit on the seat 40 and select a seat position and a foot brace position and by stretching his legs between the seat 40 and foot brace 48, providing opposing outward forces on those two components to push them apart to respective positions. Those forces are opposed by tension in the respective belts 42 and 50. The belt lengths to the fastener positions are controllable by the kayaker, and then tightened to provide a secure positioning of the respective seat 40 and foot brace 48.

Figure 3:
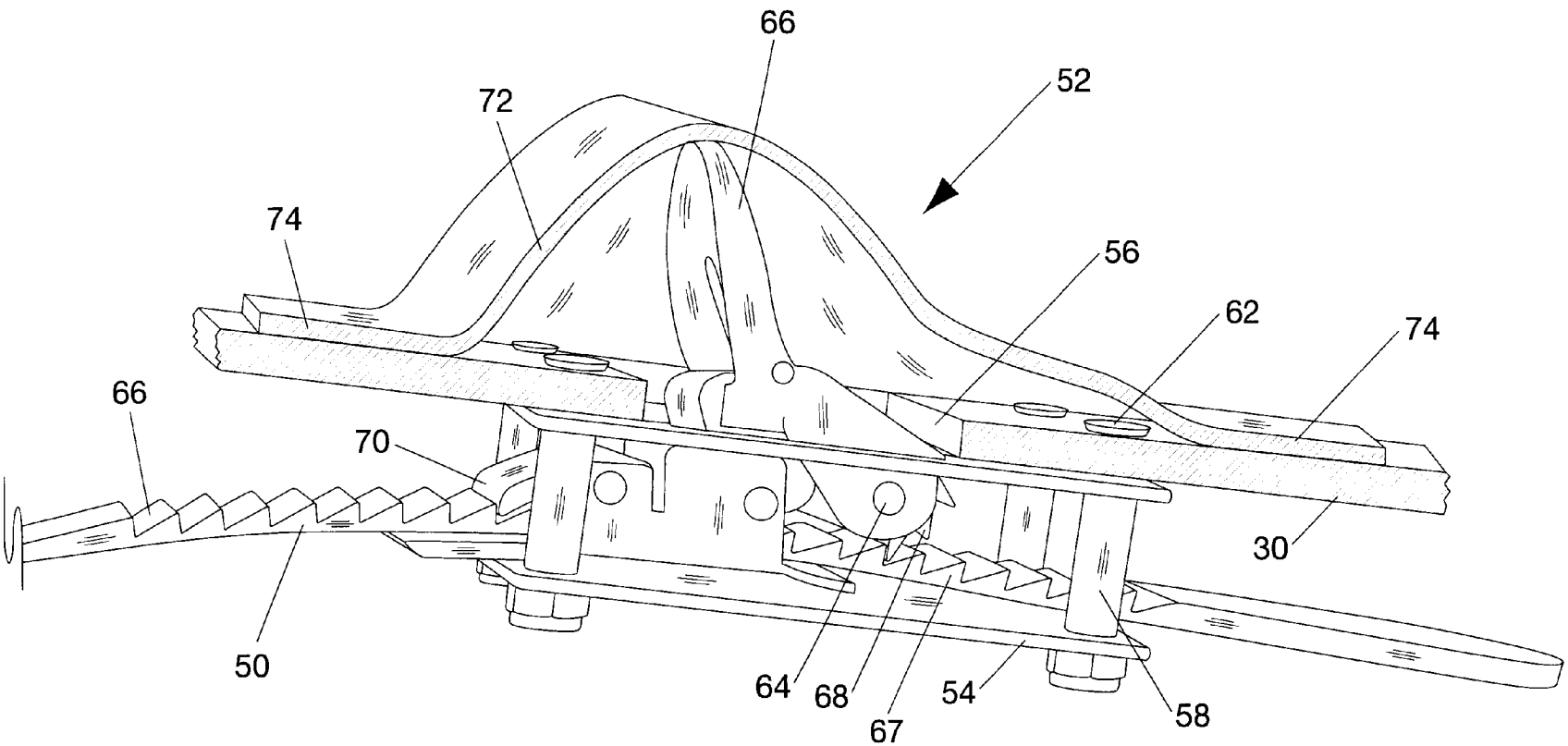
FIG. 3 is a sectional view of the embodiment of FIG. 1 taken along lines 3—3 and looking in the direction of the arrows.

The details of one embodiment of the control at opening 52 can be seen in FIG. 3. FIG. 3 is a sectional view showing the top deck portion of the kayak shell 30 supporting a cage 54. A central opening 56 in the deck is surrounded by four smaller holes through which mounting pins 58 are inserted. Securement devices such as bolts 62 engage the pins 58 to hold the cage 54 in place to the underside of the shell 30. Other mounting techniques may be substituted. Also, the cage can be substituted with other mounting mechanisms.

The cage 54 includes a ratcheting mechanism 64 having an actuating handle 66 protruding upwardly through the opening 56 and out of the shell 30. As can be seen, the belt 50 passes through the cage 54, and denticulations 67 on the belt 50 engage ratchet teeth 68 on the ratchet mechanism. The ratchet mechanism is conventional and need not be described in detail. Suffice it to say that the belt 50 can be advanced to the left in the view of FIG. 3 by manipulating the handle 66 in a clockwise fashion. Multiple articulations of the handle 66 cause multiple indexing movements of the belt 50 in that direction. A pawl 70 engages the denticulations on the belt to prevent belt movement to the right in the view of FIG. 3. A counter clockwise depression of the handle 66 removes the binding of the ratchet teeth 68 and the pawl 70, permitting the belt 50 to be moved to the right. By this means, the length of belt to the fastener position at the cage 54 may be modified.

Thus, referring again to FIG. 1, when a kayaker wishes to bring the foot brace 48 closer to the seat, he merely relieves some pressure with his feet on the foot brace 48 and manipulates the handle 66, causing the movement of belt 50, which pulls the foot brace 48 to the rear of the kayak 30. When it is desired to push the foot brace 48 forward, so that the kayaker can stretch his or her legs somewhat, or if a forward trim is desired, the handle 66 is pressed downwardly (counter-clockwise in the view of FIG. 3), releasing the grip on the belt 50, so that forward pressure on the foot brace 48 pulls the belt 50 forwardly through the cage 54.

As seen in FIG. 3, a flexible rubber sheet 72 covers the handle 66 and is sealed about its periphery 74 to the shell of the kayak 30. The sheet is flexible enough to permit the kayaker to manipulate the handle 66 through the sheet. This sheet 72 prevents water that may splash onto the deck 30 in turbulent water, or conditions that may be encountered in an Eskimo roll, from entering through the control opening 56 or the mounting openings for the pins 58.

Figure 4:
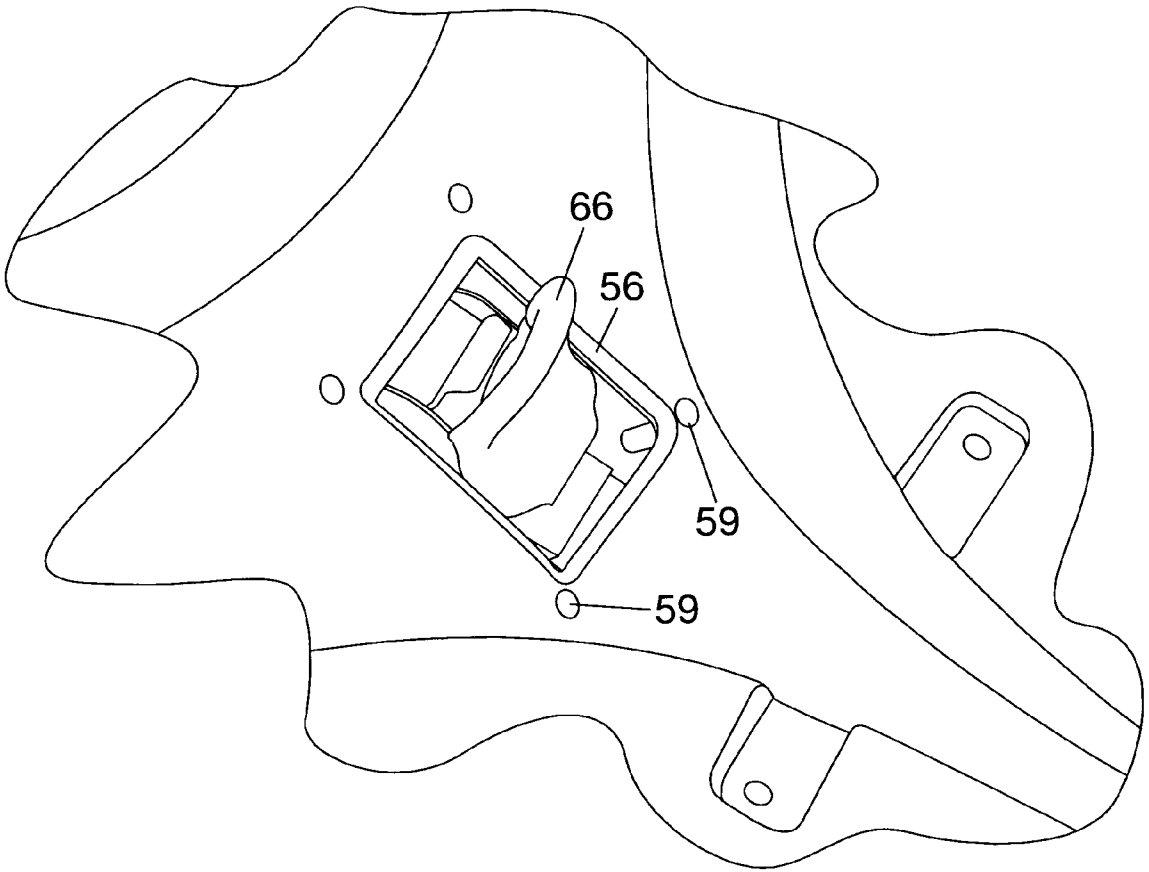
FIG. 4 is a perspective view of another embodiment without its sealing sheet.

As seen in FIG. 4, the opening 56 is provided with four surrounding smaller holes 59 through which the mounting posts 58 are adapted to pass to be secured into position by securement devices 62.

As can appreciated, the mechanism for the control opening 44 for the seat position 40 can be entirely analogous to the apparatus as seen in FIG. 3, with the difference being that the ratchet is mounted in reverse so that the belt 42 for the seat will be pulled forwardly by actuation of the ratchet mechanism and the release of the ratchet mechanism will allow the kayaker to push the seat 40 rearwardly by the force of his body.

Figure 5:
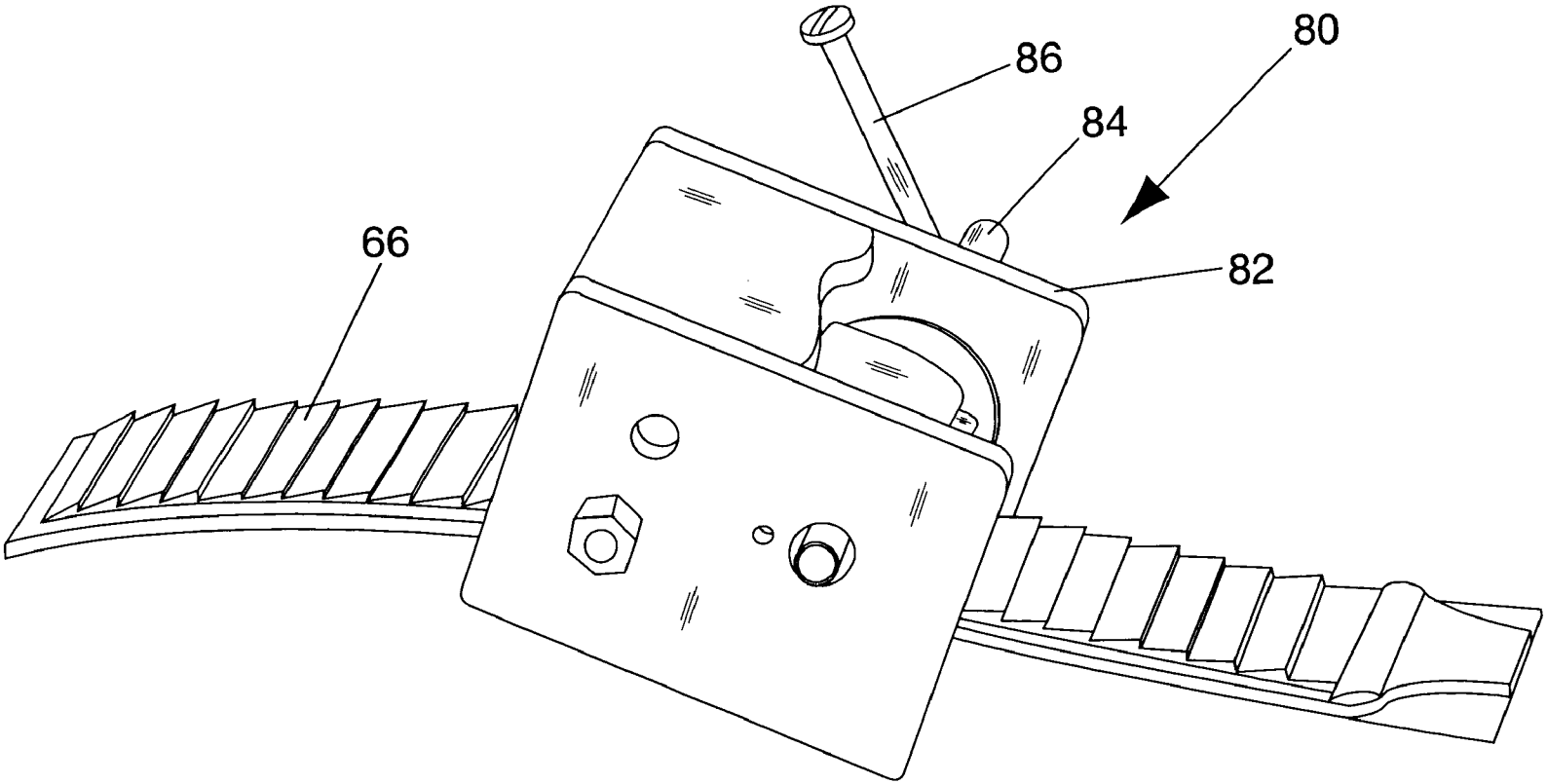
FIG. 5 is a perspective view of a water resistant mount on a metal plate that is otherwise exposed.

FIG. 5 shows another ratcheting mechanism 81 which can be used. In this apparatus the cage 82 has a rotating shaft 84 with a lever 86 which protrude from the opening 56 in the kayak shell. The cage 82 fills the opening 56 and the shaft 84 is mounted with a substantially water-tight bearing, so the rubber sheet may be eliminated. The belt in this cage passes vertically through the cage 82. This embodiment may be particularly useful if the positioning of the item to be moved causes the belt to be oriented perpendicular to the deck as it approaches the control opening. Of course, a horizontal belt, or a cable can be used with a suitable ratcheting mechanism. The details of the ratcheting mechanism of the apparatus 80 need not be detailed, as they are conventional mechanical structures.

Figure 6:
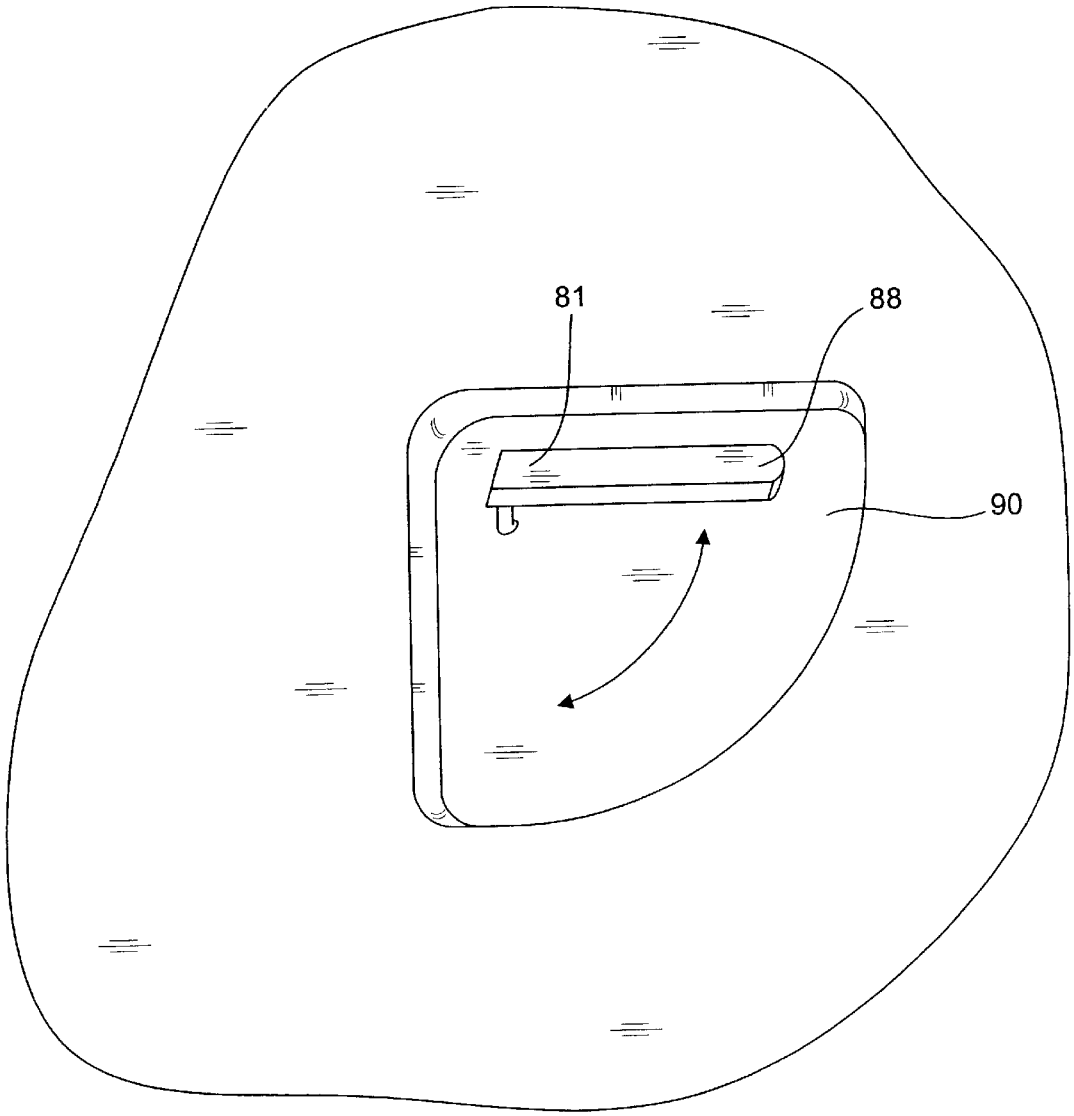
FIG. 6 is a view of a paddle craft hull in which an embodiment like that of FIG. 5 is mounted.

FIG. 6 shows the ratcheting mechanism 81 of FIG. 5 mounted to a hull of a kayak, which could be a cockpit kayak or a sit-on-top kayak. An ergonomic handle 88 may be provided. Note that the mechanism 81 is mounted in a quadrant-shaped depression 90, so that the handle 88 is flush with the kayak hull. If desired, the depression could be eliminated, with a surface mounting of the handle resulting.

The foot brace shown in FIG. 1 can be viewed in greater detail in co-pending application Ser. No. 10/214,406, filed on the same date as this application, entitled "Adjustable Foot Brace Assembly for Kayaks", assigned to the assignee of this application. The entire disclosure of that application is incorporated herein by reference. Other foot brace mechanisms can be used. For example, those seen in U.S. Pat. No. 4,942,840 to Masters, which has foot braces mounted on the sidewalls, rather than the center of the shell, can be suitably adapted with belts to allow exterior manipulation of a tensioning member in opposition to foot pressure. Rigid members may be substituted for the belts.

Figure 2:
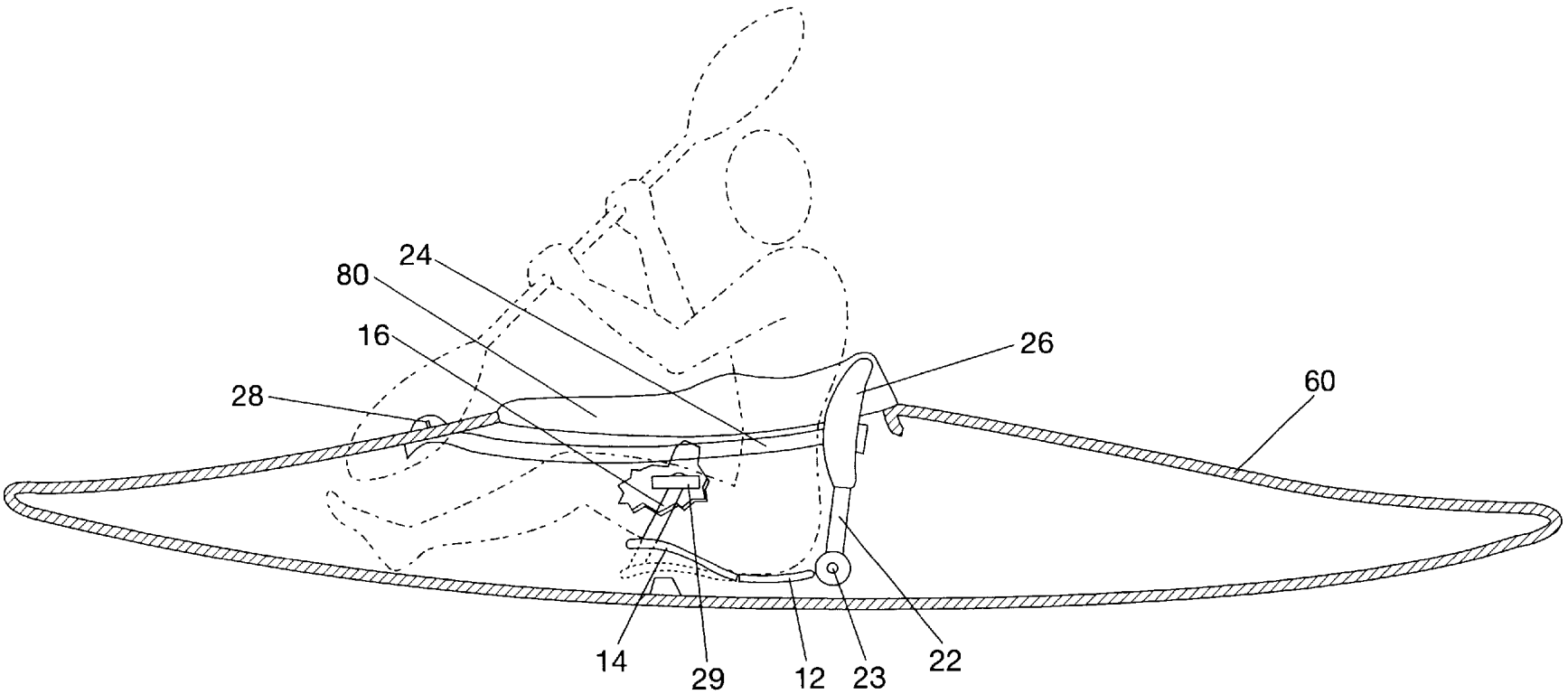
FIG. 2 is a sectional view of an alternate embodiment.

FIG. 2 shows both a further embodiment of the invention and an additional feature which can be included in the same embodiment with the features shown in FIG. 1. Here, the kayak 60 includes a pelvis support 12, an adjustable thigh support 14, and an adjustable backrest 22. The pelvis support 12 may be mounted in the cockpit by bolts, screws, clips, or any other suitable means, such as mounting on a ridge like the ridge of FIG. 1.

In this embodiment, a belt 24 extends forwardly from the backrest 22 to a control opening 28 which can be configured like the control opening of FIG. 3. The belt 24 is connected to the back support 20 and permits adjusting and setting the inclination of the back support post 22 at its pivot point 23. Also, as seen in FIG. 2, one or more straps 16 may suspend a thigh support 14 from a control opening 29. The discussion of the seat adjustments is amplified in co-pending U.S. patent application Ser. No. 09/863,015, filed May 22, 2001, entitled "Adjustable Seat for Watercraft", assigned to the assignee of the present application and published as US 2002/0175542 A1. The entire disclosure of that application is incorporated herein by reference.

Although only one seat is shown in FIGS. 1 and 2, two or more seats may be installed in a single paddle craft of suitable size, with appropriate fittings like those described here replicated for the additional seat or seats. Each of the adjustments disclosed therein, or other kayak adjustments now known or later developed can be implemented using this invention.

Although the invention has primarily been described with respect to ratcheting advancing mechanisms and denticulated belts, other suitable adjustment means may be substituted. Cords, ropes, strands, twines or the like can be substituted for the straps with suitable apparatus at the control opening serving as a means to adjust the effective length. The denticulations in the band may be made by removing holes in the band, so that the non-removed portions fit between the ratchet teeth, which enter the holes. Reels that wind components may also be substituted. A control that selectively binds the band can be used, permitting binding to hold the band and controlled loosening to allow band movement and subsequent re-tightening. Other suitable mechanisms may also be used.

In addition, the sealing sheet has been described as a flexible rubber, but any suitable material that provides the purposes of preventing the ingress of water through the control opening and yet providing the kayaker with the ability to manipulate the control mechanism may be substituted. It may also be incorporated into the skirt. Also, the adjustment control may be located inside of the skirt on the cockpit and be adjusted through the skirt.

Thus, a kayak user may sit in the cockpit of the kayak and put a skirt in place such as the skirt 80, as seen in FIG. 2. Any suitable skirt may be employed. With the skirt in place, the kayaker on a body of water can adjust items inside the kayak such as the foot brace position, seat position, back rest position, or the like by suitable manipulation of the control at the pertinent control opening. If multiple control openings are provided, labels can be provided adjacent to them to indicate to the kayaker which control affects which adjustment.

In the event the kayaker is on a river approaching whitewater and wants to shorten his leg extension to provide maximum control in the whitewater, he can easily do so without removing the spray skirt by manipulating the control for the foot brace to draw it rearwardly. If the kayaker chooses to change the trim of the kayak, he can do so by adjusting the seat position, again without removing the spray skirt. Position changes may also be motivated by comfort or ergonomic consideration. In a suitably equipped boat, the seat height may be adjusted using these techniques.

If water splashes over the deck of the kayak, it will not enter the cockpit through the control openings because of the sealing sheet or other seal associated with each control opening. Similarly, if the kayak rolls or is capsized, water will not enter through the control openings because of the presence of the sealing sheets. These features can be implemented in other paddle craft.

In other embodiments, the adjustment means can control pneumatic or hydraulic adjustments, using techniques like the Shimano Airlines shifter/derailleur system. Also, the controls can be provided as reels to wind up a line, using ratcheting devices like the apparatus of FIGS. 5 and 6.

The outside adjustment means have been described in detail with respect to cockpit-type kayaks but can also be employed in sit-on-top kayaks (including wave skis) and canoes.

Figure 7:
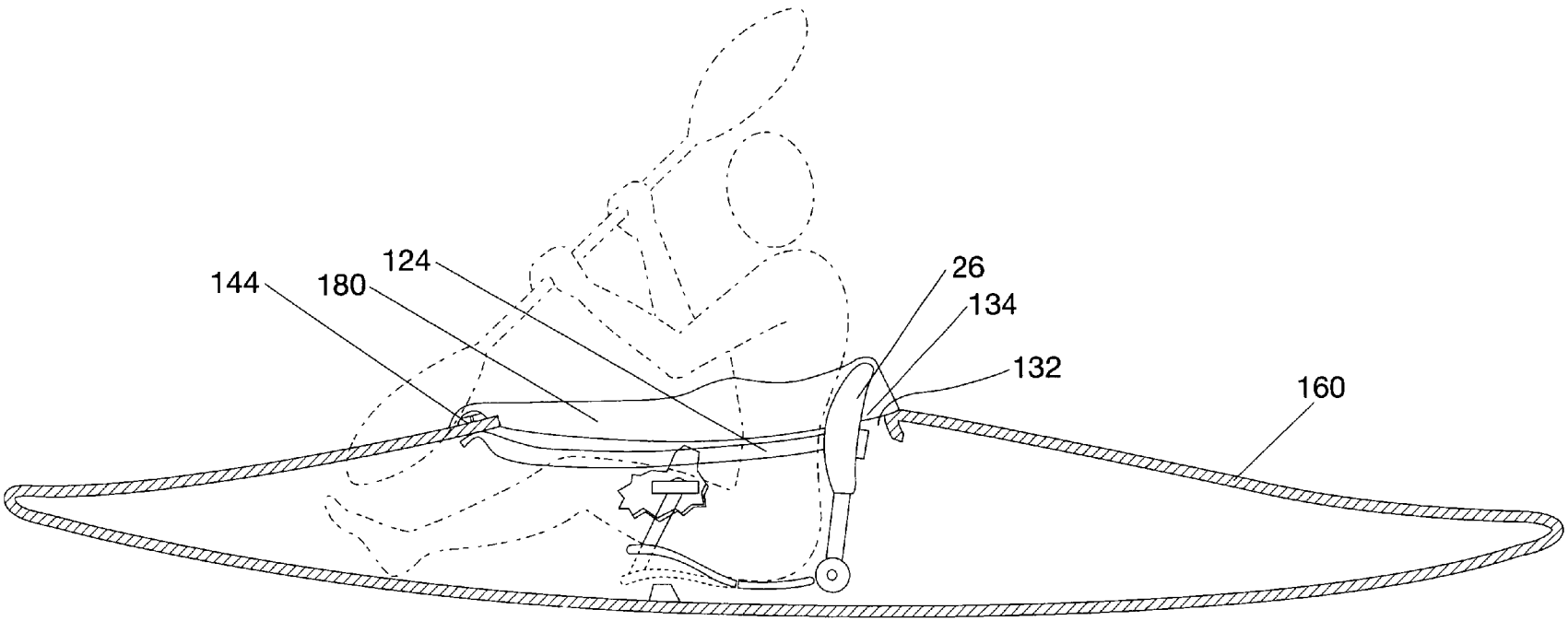
FIG. 7 is a sectional view of a further embodiment.

As seen in FIG. 7, the invention can also be provided as an improved paddle craft providing a boater with exterior controls to adjust ergonomic items within the kayak. A paddle craft shell 160 made of a substantially continuous surface prevents the ingress of water. An adjustable item 124 in the paddle craft affects the boater's ergonomics. A cockpit 132 has a cockpit opening 134. At least one control opening 144 in the shell 160 is provided within a boater's reach when the boater is sitting in the cockpit and located so as to be covered by a spray skirt 180 worn by a boater using the paddle craft.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. An apparatus for permitting adjustments of items within a paddle craft comprising an adjustment means adapted for mounting to a shell of a paddle craft, and a sealing sheet to cover the adjustment means when the adjustment means is mounted to a shell of a paddle craft and be sealed to the shell of the paddle craft, the sealing sheet having sufficient flexibility to permit a boater to manipulate the adjustment means through the sheet when the sealing sheet and adjustment means are mounted to a shell of a paddle craft.

2. An apparatus as claimed in claim 1 wherein the adjustment means includes a ratchet.

3. An improved paddle craft providing a boater with exterior controls to adjust items within the paddle craft comprising a paddle craft shell made of a substantially continuous surface to prevent the ingress of water, a cockpit having a cockpit opening and at least one control opening in the shell, the control opening being within a boater's reach when the boater is sitting in the cockpit, a control mounted to the control opening and connected with an item in the paddle craft to be controlled, and a sealing sheet covering the control and sealing the control opening to prevent water from being able to pass into the paddle craft through the control opening, the sealing sheet having sufficient flexibility to permit a boater to manipulate the control through the sheet.

4. A paddle craft as claimed in claim 3 wherein the paddle craft has a seat, and the control is a seat position control.

5. A paddle craft as claimed in claim 3 wherein the paddle craft has a foot brace, and the control is a foot brace position control.

6. A paddle craft as claimed in claim 3 wherein the paddle craft has a seat, a foot brace, two control openings and corresponding sealing sheets for the two control openings, with a first control in one of the control openings being a seat position control and a second control in a second control opening being a foot brace position control.

7. A paddle craft as claimed in claim 3 wherein the paddle craft has a seat with two adjustments, two control openings and corresponding sealing sheets for the two control openings, with a first control in one of the control openings being a first seat position control and a second control in a second control opening being a second seat position control.

8. A paddle craft as claimed in claim 3 wherein the paddle craft has an adjustable backrest, and the control is a backrest adjustment control.

9. A paddle craft as claimed in claim 3 wherein the control is a ratchet.

10. A paddle craft as claimed in claim 3 wherein the control is a ratchet connected with the item to be controlled by a band having a length and denticulations that interact with the ratchet and advance the band as the ratchet is ratcheted.

11. A paddle craft as claimed in claim 3 wherein the control is a ratchet having a toggle to tension a strap within the paddle craft.

12. A paddle craft as claimed in claim 3 wherein the control is a ratchet having a rotating handle to tension a strap within the paddle craft.

13. A paddle craft as claimed in claim 3 wherein the shell is a molded plastic.

14. A paddle craft as claimed in claim 3 wherein the paddle craft is a kayak.

15. A paddle craft as claimed in claim 14 wherein the kayak has hatch openings.

16. A paddle craft as claimed in claim 3 wherein the paddle craft has two items to be controlled with two controls for the items mounted to a single control opening.

17. A paddle craft as claimed in claim 3 wherein the item to be controlled is selected from the group consisting of:

a. a fore-and-aft seat position, b. a seat back height position, c. a seat back tilt angle, d. a thigh brace position, e. a foot brace position, and f. a seat thigh support position.

18. An improved kayak providing a boater with exterior controls to adjust items within the kayak comprising a kayak shell made of a substantially continuous surface to prevent the ingress of water, a cockpit and cockpit opening and at least one control opening in the shell, the control opening being within a kayaker's reach when the kayaker is sitting in the cockpit, a control mounted to the control opening and having a band connected to an item in the kayak to be controlled, the control including a movable mechanism accessible from outside of the shell, the mechanism advancing the band when moved to one direction and permitting retraction of the band when moved in another direction, and a sealing sheet covering the control and sealing the control opening to prevent water from being able to pass into the kayak through the control opening, the sealing sheet having sufficient flexibility to permit a kayaker to manipulate the control through the sheet.

19. An improved kayak as claimed in claim 18 wherein the item to be controlled is selected from the group consisting of:

g. a fore-and-aft seat position, h. a seat back height position, i. a seat back tilt angle, j. a thigh brace position, k. a foot brace position, and l. a seat thigh support position.

20. An improved kayak providing a kayaker with exterior controls to adjust items within the kayak comprising a kayak shell made of a substantially continuous surface to prevent the ingress of water, a cockpit and cockpit opening and three control openings in the shell, the control openings being within a kayaker's reach when the kayaker is sitting in the cockpit, a seat having an adjustable backrest, and a foot brace within the shell, a seat position control mounted to one of the control openings and having a seat position band connected to the seat to pull the seat when the band is advanced, the seat position control including a seat position mechanism for advancing the seat position band when moved to one direction and permitting retraction of the seat position band when moved in another direction, a backrest adjustment control mounted to one of the control openings and having a backrest adjustment band connected to with the backrest to pull the backrest when the backrest adjustment band is advanced, the backrest adjustment control including a backrest adjustment mechanism for advancing the backrest adjustment band when moved to one direction and permitting retraction of the backrest adjustment band when moved in another direction, a foot brace position control mounted to one of the control openings and having a foot brace position band connected to the foot brace to pull the foot brace when the foot brace band is advanced, the foot brace position control including a foot brace position mechanism for advancing the foot brace position band when moved to one direction and permitting retraction of the foot brace position band when moved in another direction, and sealing sheets covering the controls and sealing the control openings to prevent water from being able to pass into the kayak through the control openings, the sealing sheets having sufficient flexibility to permit a kayaker to manipulate the controls through the sheets.

21. An improved kayak providing a kayaker with exterior controls to adjust items within the kayak comprising a kayak shell including a deck, the shell being made of a substantially continuous surface to prevent the ingress of water, a cockpit and cockpit opening and at least one control opening in the shell, the control opening being within a kayaker's reach when the kayaker is sitting in the cockpit, a ratchet mounted to the control opening and connected with an item in the kayak to be controlled by a band having a length and width-wise ribs that interact with the ratchet and are advanced as the ratchet is ratcheted, the ratchet being selected from the group consisting of a toggle and a rotating handle, and a sealing sheet covering the control and sealing the control opening to prevent water from being able to pass into the kayak through the control opening, the sealing sheet having sufficient flexibility to permit a kayaker to manipulate the control through the sheet.

22. A method of kayaking comprising sitting in a cockpit of a kayak so that one's upper body extends out of a cockpit opening, installing a spray skirt over the cockpit opening to provide a barrier between the outside of the kayak and the interior of the kayak, floating the kayak in a body of water, and manipulating a control on the outside of the kayak to make ergonomic adjustments inside the kayak without removing the spray skirt.

23. A method as claimed in claim 22 wherein manipulating includes manipulating the control through a sealing sheet.

24. A method as claimed in claim 22 wherein manipulating includes manipulating the control to change a seat position of the kayaker within the kayak.

25. A method as claimed in claim 22 wherein manipulating includes manipulating the control to change a foot brace position.

26. A method as claimed in claim 22 wherein manipulating includes manipulating the control to change a backrest adjustment.

27. A method as claimed in claim 22 wherein manipulating includes manipulating the control to change a thigh brace adjustment.

28. A method as claimed in claim 22 wherein manipulating includes manipulating the control to change a thigh support adjustment of a seat.

29. A method as claimed in claim 22 wherein manipulating includes actuating a ratchet to advance a band having denticulations.

30. A method as claimed in claim 22 wherein manipulating includes actuating the control as covered by the spray skirt.

31. A method of kayaking comprising sitting in a cockpit of a kayak so that one's upper body extends out of a cockpit opening, installing a spray skirt over the cockpit opening to provide a barrier between the outside of the kayak and the interior of the kayak, floating the kayak in a body of water, and manipulating controls on the outside of the kayak to make adjustments inside the kayak without removing the spray skirt by actuating a ratchet through a sealing sheet to advance a band to change an adjustment selected from the group consisting of changing a seat position of the kayaker within the kayak, changing a foot brace position, changing a thigh brace position and changing a backrest adjustment.

32. An improved kayak providing a kayaker with exterior controls to adjust items within the kayak comprising a kayak shell made of a substantially continuous surface to prevent the ingress of water, a cockpit for the kayak and at least one control opening in the shell, the control opening being within a boater's reach when the boater is sitting in the cockpit, and a control which is mounted to the control opening, which is operatively connected with an ergonomic item in the kayak to be controlled, and which substantially fills the control opening to substantially prevent water from being able to pass into the kayak through the control opening.

33. An improved kayak as claimed in claim 32 wherein the kayak is a sit-on-top kayak.

34. An improved kayak as claimed in claim 32 wherein the kayak is a sit-inside cockpit kayak.

35. An improved paddle craft providing a boater with exterior controls to adjust ergonomic items within the paddle craft comprising a paddle craft shell made of a substantially continuous surface to prevent the ingress of water, an adjustable item in the paddle craft affecting a boater's ergonomics, a cockpit and cockpit opening and at least one control opening in the shell, the control opening being within a boater's reach when the boater is sitting in the cockpit, and a control which is mounted to the control opening, wherein the control opening is located so as to be covered by a spray skirt worn by a boater using the paddle craft.

36. An improved paddle craft providing a boater with exterior controls to adjust items within the craft comprising a paddle craft shell made of a substantially continuous surface to prevent the ingress of water, an adjustable item in the paddle craft affecting a boater's ergonomics, a cockpit and cockpit opening and at least one control opening, the control opening being within a boater's reach when the boater is sitting in the cockpit, and a control for the adjustable item mounted to the control opening, wherein the control has a portion that substantially fills the control opening and a manipulable handle at the control opening through a water resistant mount.

* * * * *